US005147274A

United States Patent [19]

Mandel

[11] Patent Number: 5,147,274

[45] Date of Patent: Sep. 15, 1992

[54] DOCUMENT FEEDING DOG-EAR STRAIGHTENING SYSTEM

[75] Inventor: Barry P. Mandel, Fairport, N.Y.

[73] Assignee: Xerox Corporation, Stamford, Conn.

[21] Appl. No.: 702,863

[22] Filed: May 20, 1991

[51] Int. Cl.[5] ..... B65H 47/00; B65H 5/30

[52] U.S. Cl. ..... 493/409; 493/406

[58] Field of Search ..... 493/395, 406, 409, 461, 493/465; 162/271

[56] References Cited

U.S. PATENT DOCUMENTS

| | | | |
|---|---|---|---|
| 3,027,939 | 4/1962 | Dumas | 162/271 |
| 3,807,068 | 4/1974 | Ross | 493/406 |
| 4,863,421 | 9/1989 | Loebach | 493/419 |
| 4,984,416 | 1/1991 | Duke | 493/406 |

*Primary Examiner*—William E. Terrell

[57] ABSTRACT

An apparatus and method of straightening turned over (dog-eared) or curled edges of sheets of paper or the like, particularly, original documents being fed in a document feeder. In various sheet feeders for feeding flimsy sheets of paper or the like in a sheet feeding direction through a sheet feeding path at a desired sheet movement speed, some such sheets have or acquire folded corners which are folded back relative to said sheet feeding direction. This system can automatically unfold the leading edge sheet corners with rotatable bristled brushes. The periphery of the bristled brush extends into the sheet feeding path and is rotated at a peripheral brush bristle speed with a forward vector component in the direction of sheet movement which is substantially higher than the sheet movement speed for acquiring and lifting the folded back sheet corners and forwardly unfolding them in the sheet feeding direction while the sheet continues to move. Additional non rotating brushes can be used to remove trail edge corner dog-ears.

18 Claims, 3 Drawing Sheets

DOCUMENT FEEDING DOG-EAR STRAIGHTENING SYSTEM

The present invention relates to improved sheet feeding, with particular utility for document feeders or document handlers for sequentially feeding original document sheets, for reducing the tendency for sheet feeding jams, sheet damage, or sheet sensor misreads, or other difficulties where corners of a sheet being fed are or become curled, or folded over. (Folded over sheet corners are commonly referred to in the sheet handling art as "dog-eared").

The disclosed system can automatically unfold or flatten out the folded over corners of a moving sheet, even on the front or upstream corners of sheets, without stopping or diverting the moving sheet, and without requiring any operator intervention. As shown, this may be accomplished by a simple low cost system of rotating brushes positioned to engage the corners of the moving sheet as it is being moved through a sheet path, said rotating brushes being rotatably driven in said direction of sheet movement at a rotational surface velocity and angle to the direction of sheet movement which will unfold the folded over corners of the sheets.

The disclosed system can actively unfold and flatten even such dog-ears while the dog-eared sheet is being normally fed, without interfering with such normal feeding. Although document feeding is disclosed in the example herein, the present system may also be used for copy sheet feeding. However, it will be appreciated that original documents to be copied are much more likely to have previously acquired dog-ears or weakened corners by previous handling, or even deliberate reader folding over of pages as a marker, as compared to copy sheet stock of new blank or virgin sheets of paper.

If desired, the disclosed dog-ear straightening system or process may even be done integrally within a document feeder while the sheet is being fed for copying, without delaying or interfering with that sheet feeding process. This eliminates any need to unfold the dog-ears by hand in advance in order to prevent miss-feeding and loss of copying (imaging) of the information printed on the folded-over corner portion of the document.

A document feeder or other sheet feeding process can itself put dog-ears on the sheet, for example by skewed feeding against a registration edge, catching a curled corner on a sheet path baffle, etc. These dog-ears caused by or within sheet feeding systems, including document handlers, are, of course, much more likely to be formed on the *upstream* or *leading* edge corners of the sheet. That is, a leading corner of the sheet is accidentally folded back over the sheet as the sheet is moving through the system, by encountering a resistance or obstruction. That is particularly likely for a thin flimsy sheet lacking beam strength, or previously corner-folded or otherwise previously weakened sheet corners. Yet removing such *lead* edge dog-ears has heretofore been considered much more difficult to do while or during the feeding of the sheet, because it requires catching and unfolding the dog-ear upstream (moving that sheet corner ahead of the rest of the sheet), while the rest of the sheet is moving upstream.

The present system can automatically unfold, and thus remove, such dog-ears on the upstream or leading edge corners of sheets, while the sheet is moving upstream in a document feeding system. Additionally, if desired, automatic straightening of dog-ears from the downstream or trailing edge corners of sheets may be compatibly provided. If desired, it can be provided as part of the same basic system.

It has been found by the inventor that it is preferable to use an "open surface" device such as a brush-roll to catch the edge of the sheet and straighten it out by lifting the folded corner up at its existing fold line rather than rolling it out or pressing it down as a regular closed surface roller would. This better straightens out a dog-eared sheet corner without undesirably rolling it out (with a small radius bend), or pressing it flat (which may permanently curl the corner and break paper fibers and weaken the paper at the fold line and make the corner susceptible to tearing off at the fold line).

The present system may optionally include a subsequent higher pressure roller nip, with flattening rollers engaging the sheet corner areas, following (downstream of) the rotating sheet corner straightening brushes, can "iron" substantially flat a previously dog-eared sheet corner which was straighten-out (folded out) and partially flattened by a rotating brush.

It is believed to be optionally desirable for these optional flattening rollers to be closely adjacent to the rotating brushes an/or with a sheet confining overlying baffle therebetween so that the dog-ear is not allowed to spring back and reform before it is ironed out.

Of particular interest as background art in document dog-ear control in document feeding is another recent Xerox Corporation patent, U.S. Pat. No. 5,000,438 issued Mar. 19, 1991 to Peter A. Sardano and Jeffery L. Andela, entitled "Document Feeder With Sheet Corner Control" [D/90002]. That patent describes feeding flimsy sheets of paper or the like, particularly dog-eared or curled edge original documents, through a system of sheet corner edge catching, guiding and flattening ribs, which ribs are perpendicular to the plane of the paper path, and extend diagonally transversely out away from one another and from the centerline of a sheet feeding path towards the respective outer edges of the sheet feeding path. These diagonal ribs may have their extremities in a common plane to support a normal planar sheet surface, but the spaces between ribs can catch and at least partially straighten out curled or folded corners of a moving sheet towards the respective path sides.

Also of particular interest, Taylor U.S. Pat. No. 3,957,366 notes a guide arrangement for flattening curled sheet edges.

Noted in a search was U.S. Pat. No. 3,162,435 to Rastorguyeff et al. This patent describes a system for unfolding the flap of an envelope by actuating an "envelope flap conditioning member" 60 onto the envelope. This member deflects the flap to an alternate path thus "opening" the envelope. As the envelope continues to feed, the flap is pulled down back into the main paper path in a straightened position. The inventor indicates that there is no mention of straightening dog ears on either the lead edge or the trail edge of a sheet. [The hardware shown might theoretically be modified for straightenin the dog-ears on the *trail edge* of a sheet, but not dog-ears on the *lead edge* of a sheet.] Also noted in the search was U.S. Pat. No. 4,419,003 to Fujie et al. This patent describes a system for applying tension to a sheet of paper prior to its introduction to a pressure fixing device. The goal of the invention is to prevent wrinkling, jamming and skewing of sheets in this zone. The device uses two off-axis belt/roll systems to apply tension to the sheet. The inventor indicates that this system could *not* be used for straightening folded corners of sheets since the belts provide a continuous surface of contact with the sheet.

The inventor indicates that there is no provision or mention in *either* of these two above patents of two of the key elements for performing the lead edge dog-ear straightening function in the disclosed embodiment herein. Namely, having an "open" or brush type driving medium, and means for driving that "open" or brush type medium at a speed substantially greater than the feeding velocity of the sheet being transported. And also, rotation at an appropriate angle to the movement path or direction of sheet feeding, which is interrelated to the brush velocity. That is, in the disclosed embodiment herein, the desired high rotational speed of the dog-ear straightening brush(s) depends on their angle relative to the direction of motion of the sheet.

Of course, rotating brushes or brush rollers per se have been used in other, different, sheet feeding (stacking, gateing, etc.) applications. For example, U.S. Pat. No. 4,988,087 issued Jan. 29, 1991 to Sardano et al, and art cited therein. Or the Xerox Disclosure Journal Vol. 4, No. 3, May/Jun. 1979, page 331 (no drawing) entitled "Bristle Roll Inverter" by Hawkins, et al.

The disclosed system for actively unfolding and flattening curled or dog-eared sheets may desirably be directly integrated into the document feeding path of any of various automatic document feeders or handlers (alternatively referred to herein as an "ADF" or automatic document feeder), including a recirculating document handler (RDH). The disclosed document feeders per se are merely exemplary. The present apparatus could also be used in a duplex or other recirculating document handlers, as shown, for example, in Xerox Corporation U.S. Pat. No. 4,881,729 issued Nov. 21, 1989 or U.S. Pat. No. 4,884,794 issued Dec. 5, 1989 or U.S. Pat. No. 4,849,788 issued Jul. 18, 1989. Some other current examples of recirculating document handlers in general are disclosed in U.S. Pat. Nos. 4,076,408; 4,176,945; 4,278,344; 4,330,197; 4,621,801; 4,466,733; and 4,428,667. Current examples of retard type document feeders in which the present apparatus could also be used are shown in Canon U.S. Pat. Nos. 4,727,398 to T. Honjo et al issued Feb. 23, 1988, 4,723,722 issued Feb. 9, 1988 to T. Hoji, et al, 4,627,709 issued Dec. 9, 1986 to T. Kitajima et al, and 4,544,148. Various possible specific hardware components of the exemplary document feeder apparatus are known per se in these and other apparatus or applications.

As xerographic and other copiers increse in speed, and become more automatic, it is increasingly important to provide higher speed yet more reliable and more automatic handling of the document sheets being copied, i.e. the input to the copier. It is desirable to reliably feed and accurately register for copying document sheets of a variety or mixture of sizes, types, weights, materials, conditions and susceptibility to damage. Yet, with this and other stack sheet feeding, it is is very desirable to provide minimal double-feeding (mis-separations), misfeeding, or skewing, and minimal document jamming, wear or damage, even if the same documents are automatically fed and registered repeatedly, as for recirculating document pre-collation copying. Original document handling, particularly for delicate, valuable, thick or irregular documents, is often more difficult and critical than feeding blank or virgin sheets, particularly for documents with typing, smearable ink, fuser oil or other materials thereon susceptible of smearing or contamination of other documents by the sheet separation and feeding process. The images on documents (and/or their fusing if they are themselves copies), can change the sheet feeding characteristics and these images may be subject to damage in feeding if not properly handled, especially smearing of freshly typed typewriting ink, freshly printed ink jet printer output, etc.. Original documents can vary widely in sheet size, weight, thickness, material, condition, humidity, age, etc.. Documents may even have curls, wrinkles, tears, "dog-ears", cutouts, overlays, tape, paste-ups, punched holes, staples, adhesive, or slippery areas, or other irregularities. Unlike copy sheets, which generally are from the same new clean batches and therefore of the same general condition and size, documents can often vary considerably even if they are all of the same "standard" size, (e.g. letter size, legal size, A-4, B-4, etc.). Documents, even in the same document set, may have come from different paper batches or have variably changed size with different age or humidity conditions, different imaging, etc.

Avoidance of sheet skewing during feeding and maintaining proper registration and feed timing of documents is also important. If the document is not properly fed to and registered on the platen, then undesirable dark borders and/or edge shadow images may appear on the ensuing copy sheet, or information near an edge of the document may be lost, i.e., not copied onto the copy sheet. Document misregistration, especially skewing, can also adversely affect further feeding, ejection, and/or restacking of the documents.

In the description herein the term "document" or "sheet" refers to a usually flimsy sheet of paper, plastic, or other such conventional individual image substrate. The "document" is the sheet (original or previous copy) being copied in the copier onto the "copy sheet", which may be abbreviated as the "copy". Related, e.g. page order, plural sheets of documents or copies are referred to as a "set". A "simplex" document or copy sheet is one having its image and page number on only one side or face of the sheet, whereas a "duplex" document or copy sheet has "pages", and normally images, on both sides.

One specific feature disclosed herein is to provide, in a sheet feeding method and apparatus for feeding flimsy sheets of paper or the like in a sheet feeding direction through a sheet feeding path thereof, automatically unfolding folded over corners of a sheet, by normally moving said sheet in a sheet feeding direction through a sheet feeding path at a normal sheet movement speed, engaging lead edge area corners of said sheets which are folded back relative to said sheet feeding direction with rotating brush bristles extending into said sheet feeding path while said sheet continues to move at said normal sheet movement speed, rotating said rotating brush bristles engaging said lead edge area corners of said sheets at a peripheral speed having a forward vector velocity component in said sheet feeding direction which is substantially higher than said normal sheet movement speed, and acquiring, lifting, and unfolding said folded back sheet corners forwardly, in said sheet feeding direction, with said rotating brush bristles while said sheet continues to move in said sheet feeding direction.

Further features which may be provided by the system disclosed herein, individually or in combination, further includes apparatus or steps for subsequently ironing out the unfolded sheet corners with a pressure nip engaging said sheet in said sheet feeding path downstream from the rotating brush bristles; and/or further including a coordinated step of automatically unfolding folded over sheet corners which are at the trailing edge of the sheet and are folded forward relative to said sheet feeding direction, while the sheet is moving in said sheet feeding path, by catching said trailing edge folded forward sheet corners as they move past a catching member and rearwardly unfolding those sheet corners; and/or wherein said rotating brush bristles are rotated about an axis of rotation at an angle to said sheet feeding path and said sheet feeding direction; and/or wherein said angle is approximately 45 degrees; and/or wherein said rotating brush bristles are provided by two rotating brushes, respectively located on opposite sides of said sheet feeding path to engage opposite corners of a sheet moving in said sheet feeding path; and/or wherein said two rotating brushes are rotatably driven about axes of rotation oppositely angled outwardly of the sheet path such that the relative velocity vector between said peripheral brush bristles and the moving sheet is approximately 45 degrees for each; and/or wherein one of said two rotatable brushes is extended substantially axially longer than the other transversely of said sheet feeding paths to engage different sizes of sheets in said sheet feeding path.

All references cited in this specification, and their references, are incorporated by reference herein where appropriate for appropriate teachings of additional or alternative details, features, and/or technical background.

Various of the above-mentioned and further features and advantages of the invention will be apparent from the apparatus and its operation described in the specific examples below. Thus, the present invention will be better understood from the following description of these exemplary embodiments thereof, including the drawing figures (approximately to scale) wherein.

Figure 1:
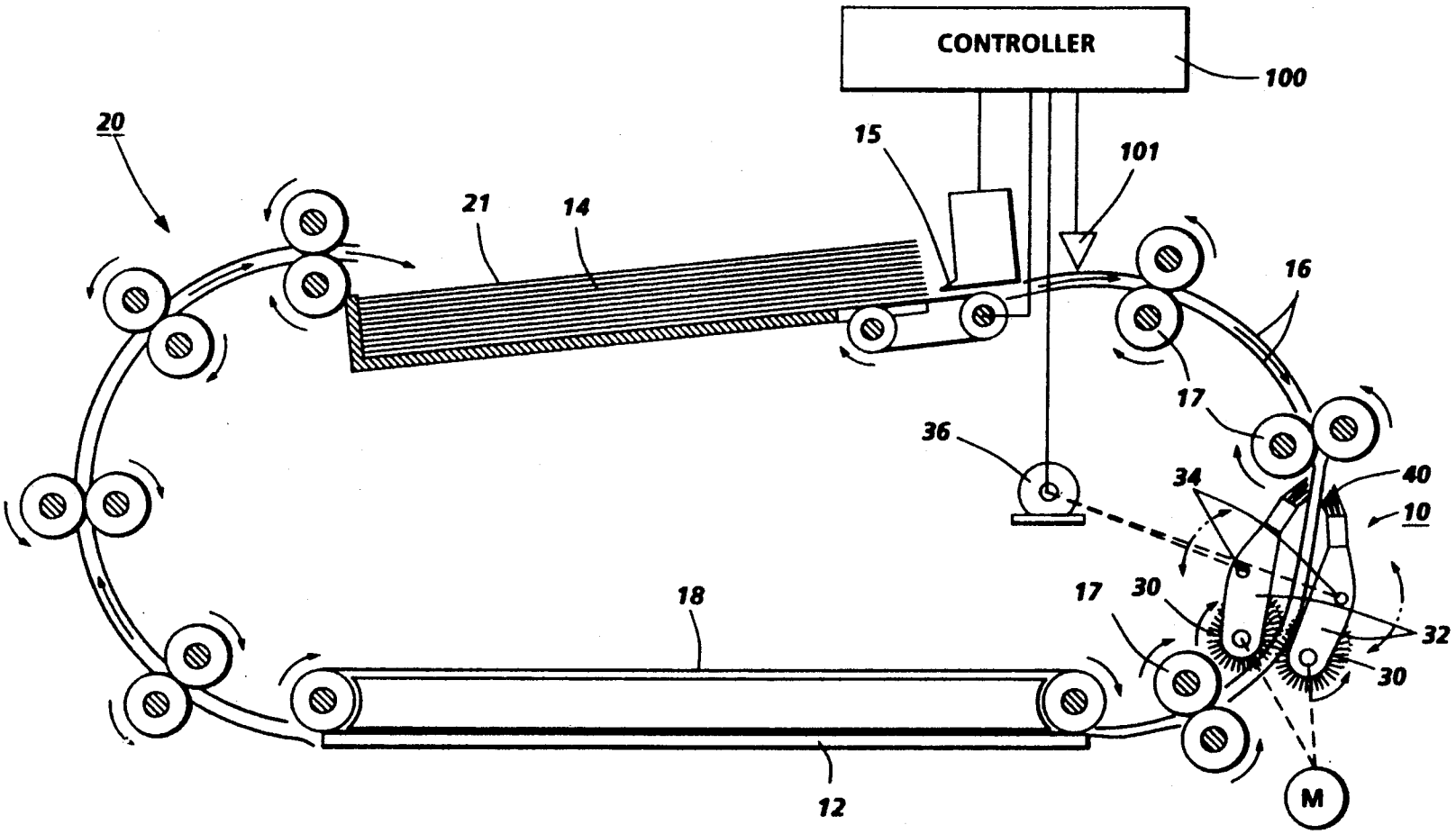
FIG. 1 is a partly schematic side view of an exemplary document handler incorporating one example of an automatic sheet dog-ear straightening apparatus and method in accordance with the present invention in a portion of the document path upstream of the imaging platen.
Figure 2:
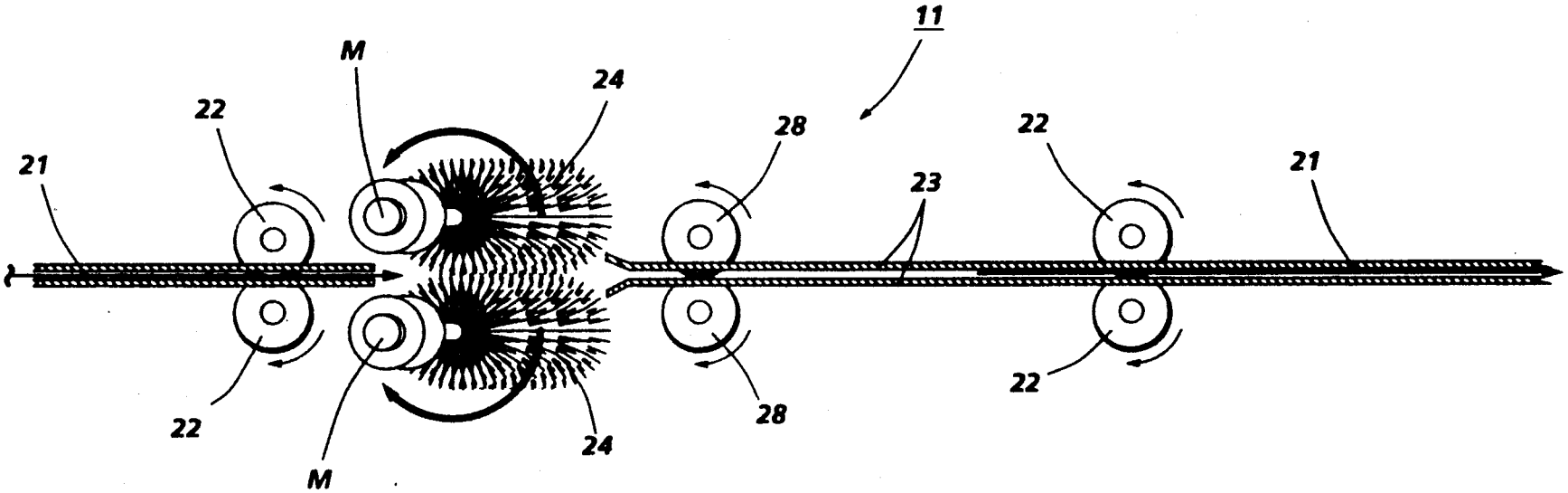
FIG. 2 is an enlarged partly schematic side view of another automatic sheet dog-ear straightening apparatus, similar in part to that of FIG. 1, in a straight (rather than curved) paper path area.
Figure 3:
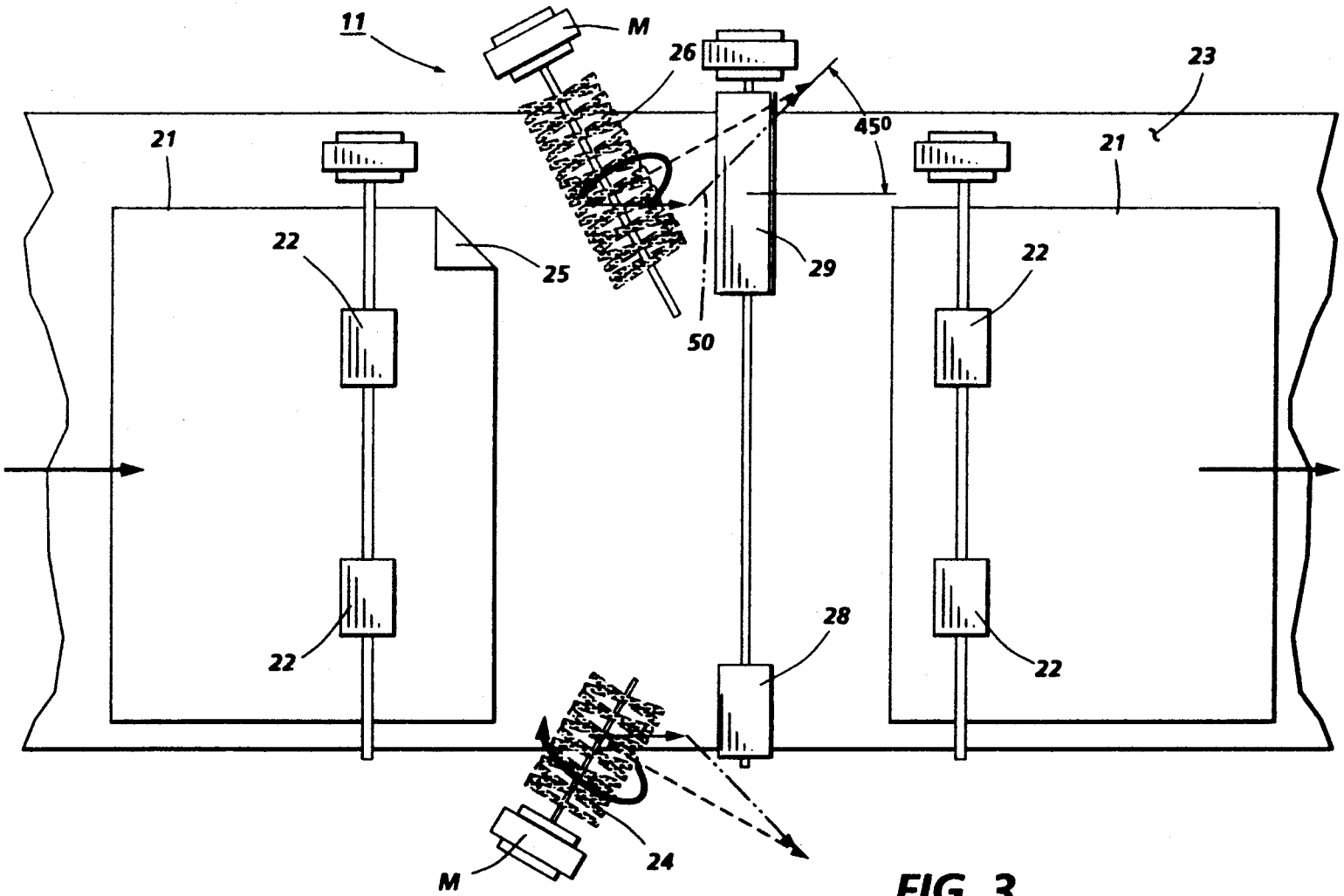
FIG. 3 is a top view of the apparatus of FIG. 2, with the upper baffle removed for illustration clarity.

The disclosed automatic sheet dog-ear straightening apparatus 10 of FIGS. 1, and 11 of FIGS. 2 and 3, are exemplary, and may also vary with the particular document or copy sheet path in which they are mounted and employed. The exemplary, otherwise conventional, recirculating document handler (RDH) 20 in FIG. 1 is shown as one suitable application, at one suitable location. It will be appreciated that the automatic dog-ear straightening apparatus 10 or 11 or the like may be utilized with various other document handlers, copiers, scanners or other sheet feeders, and/or other applications, including various of those cited herein. Thus the only portion of an exemplary copier illustrated here is the copier platen 12 shown in FIG. 1.

The exemplary RDH 20 disclosed in FIG. 1 is otherwise like that of the above-cited or other patents thereon, and thus not be redescribed here. (As noted in those patents, an integral duplex document inverter may also be provided, but need not be shown here.) As conventionally practiced, document sheets 21 to be copied may separated and sequentially fed from a document stack 14 by a separator/feeder 15 and through an arcuate upstream sheet feeding path 16 with transport feed rollers 17 towards the platen 12, in the direction of the illustrated arrows. The document is then driven over the platen 12 surface into a desired copying registration position by the platen transport belt system 18. The document 21 is then ejected by the platen transport 18 from the platen 12 after it is copied, and may be returned to the stack 14, as shown, for recirculative, pre-collation, copying.

The document feeder 20 may alternatively be utilized as a non-recirculating automatic document feeder by not returning the documents to the tray after copying. After copying, documents may be ejected from the opposite, downstream, end of the platen into an output inverting path which inverts the documents and ejects them up into an output restacking tray (not shown).

Conventionally connected to the copier controller 100 are document sheet lead and/or trail edge sensors such as 101 strategically positioned around the document path, schematically illustrated here as solid arrowheads. These sensors conventionally track the position and timing of the sheet being fed.

Such sheet feeding paths such as 16 in FIG. 1 normally include, as here, or at 23 in FIG. 2, opposing spaced apart sheet feeding guide baffles, usually flat or with ribs extending in the sheet movement direction. Dog-eared or curled up edge documents need to be fed without damage. [An exemplary dog-ear is shown at 25 in FIG. 3.] The disclosed system utilizes the fact that a sheet will have its two opposing edge corners, which may have dog-ears, feeding through the two opposite sides of said sheet feeding path. The system here reduces feeding difficulties where some such sheet corners have dog-eared or curled up edges, as is quite often the case with original documents, by straightening them out during normal sheet feeding.

Describing now in further detail the specific examples illustrated in the Figures of the automatic dog-ear straightening apparatus 10 or 11, the FIGS. 2 and 3 embodiment 11 will be described first. This is another example of typical sheet apparatus for feeding flimsy sheets of paper or the like in a sheet feeding direction through a sheet feeding path, which path in this FIGS. 2 and 3 embodiment 11 is generally planer in the illustrated portion thereof, as opposed to the arcuate path of FIG. 1 embodiment 10. A sheet 21, which may have a dog-eared (folded-over) corner 25 is normally fed in the direction of the illustrated movement arrows by normal centrally engaging sheet feed rollers 22 (like the rollers 17 in FIG. 1) between baffles 23. The sheet is fed into nipped (engaging) pairs of generally cylindrical rotatably driven M brush rolls 24 and 26 on opposite sides of the path. The brush rollers 26 may be axially longer, as shown, to accommodate different sheet widths in the dimension transverse the sheet path. The sets of brush rollers 24 and 26 are mounted in a position to engage the corners of each sheet 21 moving through the system, and to unfold any folded over corners 25 of the lead edge corners of the sheet. The rotating brushes 24 and 26 are rotatably driven so that the periphery bristles are moving generally in the direction of sheet movement, but faster than the sheet movement. Also, the brushes 24 and 26 axes of rotation are preferably angled outwardly of the sheet path, such that the relative velocity vector 50, between the brush periphery and the sheet, is approximately 45 degrees, as shown here. Thus, a rotational brush surface velocity and angle to the direction of sheet movement is provided which will unfold any folded over leading corner 25 (or opposite corner) of each sheet 21.

Although not limited thereto, it has been found that a cylindrical brush of a known or conventional low cost type, having radial plastic fibers extending from a small central core shaft, as shown, such as a "bottle brush", has an "open" surface that catches the sheet corner with the brush fiber tips in advance of the nip and straightens the sheet corner out without damage, at an uncritical speed of rotation, providing the vector component of the brush surface speed in the direction of sheet movement is substantially higher than the sheet movement speed.

Optionally additionally provided in this exemplary system 10 are subsequent higher pressure roller nips provided by flattening rollers pairs 28 and 29. The flattening rollers pairs 28 and 29 may be of conventional elastomers sheet roller material, and are also positioned to engaging the sheet corner areas as they pass by, but following (down-stream of) the rotating brushes 24, 26, so as to "iron" substantially flat a previously dog-eared sheet corner which was straightened out (folded out) and partially flattened by a rotating brush, as described above. It is also believed to desirable for these optional flattening rollers 28 and 29 to be closely adjacent to the rotating brushes 24, 26, and/or with sheet confining overlying baffles 23 therebetween, as shown, so that the brush turned over dog-ear is not allowed to spring back and reform before it is ironed out.

The dog-ear straightening system 10 of FIG. 1 is basically as described above, except that in this embodiment the similar lead edge dog ear straightening brush rollers 30 (only the front side pair 30 is shown here) are each shown pivotally mounted on arms 32 pivotal about axes 34 to be automatically disengageable (moved out of the sheet path) by a suitable pivoting mechanism 36 actuated by controller 100, if desired. There are four such arm 32 units here.

Also in this embodiment 10, the other end of each pivotal arm 32 additionally has a non-rotating brush 40 positioned to catch and straighten out a *trail* edge corner dog-ear. Thus the system 10 can automatically unfold, and thus remove, *all* dog-ears. The dog-ears on the upstream or leading edge corners of sheets are removed by the fast rotating brush rollers 30, while the sheet is moving upstream in the document feeding system. Also, automatic straightening of dog-ears from the downstream or trailing edge corners of sheets may be compatibly provided by the four non-rotating brushes 40. If desired, the brushes 40 can be kept out of the paper path except when the arms 32 are rotated (by any suitable mechanism 36) about axes 34 so that the brush 40 ends are in the paper path 16. Here, that same pivotal brush 40 engagement movement also disengages the brush rollers 30. The sheet path sensors, such as 101, can be used to control the timing of the rotation of the arm 32 units relative to each sheet 21 movement thereby so that the brushes 30 only engage the sheet *lead* edge area, and the brushes 40 only engage the sheet *trail* edge area. This is all done without any operator intervention, and while the document sheet is moving normally, without any pauses or delays.

While the embodiments disclosed herein are preferred, it will be appreciated from this teaching that various alternatives, modifications, variations or improvements therein may be made by those skilled in the art, which are intended to be encompassed by the following claims:

I claim:

1. In a sheet feeding apparatus for feeding flimsy sheets of paper in a sheet feeding direction through a sheet feeding path at a desired sheet movement speed, wherein some such sheets have acquired folded over lead edge area corners which are folded back relative to said sheet feeding direction; the improvement comprising means for automatically unfolding said folded over sheet lead edge area corners while said sheets continue to move in said sheet feeding direction, comprising rotatable brush means with rotatable peripheral brush bristles thereof operatively extending into said sheet feeding path for engaging the sheets moving therein and with means for rotating said peripheral brush bristles at a peripheral brush bristle speed having a forward vector component in said sheet feedign direction which is substantially higher than said sheet movement speed for acquiring and lifting said folded back sheet corners and forwardly unfolding said folded back sheet corners in said sheet feeding direction while the sheet continues to move in said sheet feeding direction.

2. The sheet feeding apparatus of claim 1, further comprising additional means for automatically unfolding folded over sheet corners which are at the trailing edge of the sheet and are folded forward relative to said sheet feeding direction, while the sheet is moving in said sheet feeding path.

3. The sheet feeding apparatus of claim 1, further comprising stationary brush means which are extended into said sheet feeding path for automatically unfolding folded over sheet corners which are at the trailing edge of a sheet in said sheet feeding path.

4. The sheet feeding apparatus of claim 1, wherein said rotatable brush means are rotated about an axis of rotation at an angle to said sheet feeding path and said sheet feeding direction.

5. The sheet feeding apparatus of claim 1, wherein said rotatable brush means consists of two rotatable brushes, respectively located on opposite sides of said sheet feeding path to engage opposite corners of a sheet moving in said sheet feeding path.

6. The sheet feeding apparatus of claim 4, wherein said angle is approximately 45 degrees.

7. The sheet feeding apparatus of claim 2, wherein said additional means for automatically unfolding folded over sheet corners which are at the trailing edge of a sheet moving in said sheet feeding path and are folded forward relative to said sheet feeding direction comprises a non rotating brush operatively stationarily extended into said sheet feeding path to catch said trailing edge folded forward sheet corners as they move past said brush and rearwardly unfold those sheet corners.

8. The sheet feeding apparatus of claim 5, wherein said two rotatable brushes are rotatably driven about axes of rotation oppositely angled outwardly of the sheet path such that the relative velocity vector between said peripheral brush bristles and the moving sheet is approximately 45 degrees for each.

9. The sheet feeding apparatus of claim 5, wherein one of said two rotatable brushes is substantially axially longer than the other to engage different sizes of sheets in said sheet feeding path.

10. The sheet feeding apparatus of claim 5, further including means for ironing out said unfolded sheet corners with a pressure nip engaging said sheet in said sheet feeding path downstream from said rotatable brushes.

11. A method of automatically unfolding folded over corners of a sheet, comprising the steps of:

normally moving said sheet in a sheet feeding direction through a sheet feeding path at a normal sheet movement speed, engaging lead edge area corners of said sheets which are folded back relative to said sheet feeding direction with rotating brush bristles extending into said sheet feeding path while said sheet continues to move at said normal sheet movement speed, rotating said rotating brush bristles engaging said lead edge area corners of said sheets at a peripheral speed having a forward vector velocity component in said sheet feeding direction which is substantially higher than said normal sheet movement speed, and acquiring, lifting, and unfolding said folded back sheet corners forwardly, in said sheet feeding direction, with said rotating brush bristles while said sheet continues to move in said sheet feeding direction.

12. The method of automatically unfolding folded over corners of a sheet of claim 11 further including a subsequent step of ironing out said unfolded sheet corners with a pressure nip engaging said sheet in said sheet feeding path downstream from said rotating brush bristles.

13. The method of automatically unfolding folded over corners of a sheet of claim 11 further including a coordinated step of automatically unfolding folded over sheet corners which are at the trailing edge of the sheet and are folded forward relative to said sheet feeding direction, while the sheet is moving in said sheet feeding path, by catching said trailing edge folded forward sheet corners as they move past a catching member and rearwardly unfolding those sheet corners.

14. The method of automatically unfolding folded over corners of a sheet of claim 11, wherein said rotating brush bristles are rotated about an axis of rotation at an angle to said sheet feeding path and said sheet feeding direction.

15. The method of automatically unfolding folded over corners of a sheet of claim 14, wherein said angle is approximately 45 degrees.

16. The method of automatically unfolding folded over corners of a sheet of claim 14, wherein said rotating brush bristles are provided by two rotating brushes, respectively located on opposite side of said sheet feeding path to engage opposite corners of a sheet moving in said sheet feeding path.

17. The method of automatically unfolding folded over corners of a sheet of claim 14, wherein said rotating brush bristles are provided by two rotating brushes, respectively located on opposite sides of said sheet feeding path to engage opposite corners of a sheet moving in said sheet feeding path, and rotatably driven about axes of rotation oppositely angled outwardly of the sheet path such that the relative velocity vector between said peripheral brush bristles and the moving sheet is approximately 45 degrees for each.

18. The method of automatically unfolding folded over corners of a sheet of claim 17, wherein one of said two rotatable brushes is extended substantially axially longer than the other transversely of said sheet feeding paths to engage different sizes of sheets in said sheet feeding path.

* * * * *